United States Patent [19]

Tamura

[11] Patent Number: 4,975,677

[45] Date of Patent: Dec. 4, 1990

[54] GUIDED VARIABLE RESISTOR

[75] Inventor: Shigeki Tamura, Tokyo, Japan

[73] Assignee: Fostex Corporation of Japan, Tokyo, Japan

[21] Appl. No.: 391,129

[22] Filed: Aug. 8, 1989

Related U.S. Application Data

[63] Continuation-in-part of Ser. No. 159,831, Feb. 24, 1988, Pat. No. 4,878,040.

[51] Int. Cl.[5] ..... H01C 10/28; H01C 10/38

[52] U.S. Cl. ..... 338/158; 338/162; 338/176; 338/157

[58] Field of Search ..... 338/176, 174, 162, 157, 338/158; 29/610.1

[56] References Cited

U.S. PATENT DOCUMENTS 298,073 5/1884 Doyle ..... 338/158 X 3,384,850 5/1968 Cameron et al. ..... 338/158

3,671,915 6/1972 Sasaki et al. ..... 338/176 X

*Primary Examiner*—Bruce A. Reynolds

*Assistant Examiner*—Marvin M. Lateef

*Attorney, Agent, or Firm*—Price, Gess & Ubell

[57] ABSTRACT

A variable resistor including a resistive element and a conductive element supported by a plate. Contacting terminals are provided on one or more ends of each element. A carriage is slidably supported above the elements and a conductive roller is supported from the carriage by a suspension member that biases the conductive roller against the elements. The effective length of the current path through the resistive element is varied by using the conductive roller to electrically connect the two elements to one another along different portions of their length. In a preferred embodiment, the carriage moves under the guidance of at least one guide bar and the conductive roller is suspended from the carriage by a coiled spring.

18 Claims, 4 Drawing Sheets

GUIDED VARIABLE RESISTOR

This application is a Continuation-in-Part of U.S. Ser. No. 159,831, filed Feb. 24, 1988, now issued at U.S. Pat. No. 4,878,040.

BACKGROUND OF THE INVENTION

1. Field of the Invention

The present invention relates generally to variable resistors and, more specifically, to an improved guided variable resistor that minimizes noise and wear resulting from use.

2. Description of the Related Art

Variable resistors have typically utilized a sliding element resembling a brush wherein the brush slides across a surface of a resistive element and a conductive element to vary resistance. However, noise is generated as a result of the brush element lifting from the resistor element as it slides across the resistor element and the conductive element. Obviously, noise generation becomes more of a problem as the need for steady resistance increases.

There is an additional problem in that the sliding brush element makes it difficult to achieve a smooth sliding motion. The rough sliding motion, caused by the large amount of friction that typically exists between the sliding element and the resistive and conductive elements, adversely affects the degree to which the variance of resistance can be controlled.

Another problem has been performance deterioration over time. This results from the constant frictional wear caused by the sliding of the brush element across the resistor and conductive elements each time the resistance is changed.

At least one prior art variable resistor has used a rolling contact member that is biased against the resistive and conductive elements by a spring. Such devices, however, are complicated, requiring a large number of components and a lengthy assembly time.

A need therefore still exists in the art to provide an improved sliding type variable resistor which minimizes wear and noise and which is simple in construction.

SUMMARY OF THE INVENTION

An object of the present invention is to provide an improved strip-shaped variable resistor;

Another object of the present invention is to provide a variable resistor that minimizes the amount of wear and noise generated from use;

Another object of the present invention is to provide a variable resistor that is simple to construct; and Another object of the present invention is to provide a sliding type variable resistor that can be used in various orientations.

The objects of the present invention are achieved by providing a strip-shaped conductive element, a strip-shaped resistive element, and a support element or plate for supporting the conductive element and the resistive element. A contact element is also provided for electrically connecting the conductive element and the resistive element. A slider or carriage moves the contact element under the guidance of guide bars located above the resistive and conductive elements. The slider is provided with a hook and a pair of protrusions. A spring suspension member having a pair of coiled sections is installed on the protrusion and locked in place with the hook. The coiled spring further has two arms which extend from each of the coiled sections, the far end of each of the extending arms being bent back in a hairpin-like fashion in order to accommodate the shaft of a conductive roller. When installed, the conductive roller supported by the extending arms of the coiled spring and is biased against the resistive element and the conductive element under pressure from the coiled spring. The effective length of the resistive element is changed as the conductive roller moves along. As a result, the resistance between the terminals connected to the resistive and conductive elements will change. Upon activation, the conductive element remains in rolling contact with the resistive element while eliminating substantially all sliding contact.

These and other objects of the present invention can be best understood from an examination of the accompanying specification, the claims, and the drawings.

DETAILED DESCRIPTION OF THE PREFERRED EMBODIMENT

The following description is provided to enable any person skilled in the art to which the present invention pertains, or with which is most nearly connected, to make and use the same and sets forth the best mode contemplated by the inventors of carrying out their invention. Various modifications, however, will remain readily apparent to those skilled in the art since the generic principles of the present invention have been defined herein specifically to provide a guided variable resistor.

Figure 4:
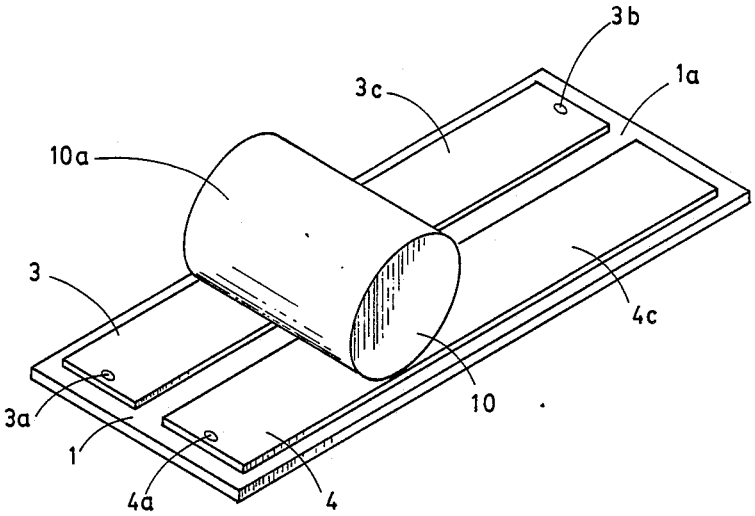
FIG. 4 is a partial perspective view of the present invention.

FIG. 4 shows a component assembly of the present invention including an insulator plate 1 which, in this particular embodiment, is planar and rectangular shaped. The insulator plate 1 is made of any appropriate conventional material that has a high insulating property and is preferably made of bakelite paper. The insulator plate 1 also has a sufficiently rigid character to prevent bending or flexing when in use.

A strip-shaped resistive element 3 is affixed to a top, planar side 1*a* of the insulator plate 1. For example, the resistive element 3 may be adhered to or may be silk screened on the insulator plate 1. In this particular embodiment, the resistive element 3 is rectangular shaped and approximately less than one-half of the dimensions of the insulator plate 1. The resistive element 3 is constructed of any appropriate conventional high-resistive element, and is preferably made of a carbon coating. A pair of connecting terminals 3*a*, 3*b* are connecting terminal is located at each opposite end along the longitudinal length of the resistive element 3. As further described below, the connecting terminals 3*a*, 3*b* provide an electrical connection between either of them and a conductive element 4.

A strip-shaped conductive element 4 is affixed to the insulator plate 1 by means similar to that of the resistive element 3 such that the conductive element 4 and the resistive element 3 are positioned substantially parallel to one another on the top planar side la of the insulator plate 1. The conductive element 4 is configured and dimensioned like the resistive element 3. The conductive element 4 is made of any appropriate material having a high conductive property, and is preferably made of a silver coating. A connecting terminal 4*a* is provided on an upper planar surface 4*c* of the conductive element 4 at one end thereof so as to be positioned adjacent the connecting terminal 3*a*, in this particular embodiment.

A cylindrical-shaped roller element 10 is positioned above and in contact with the top planar surfaces of the resistive element 3 and the conductive element 4 in order to provide electrical conduction between those two elements. The roller element 10 has a smooth, rolling contact surface 10*a* that remains in rolling contact with the resistive and conductive elements during variance of resistance. The roller element 10 may be made of a conductive silicon rubber.

Figure 1:
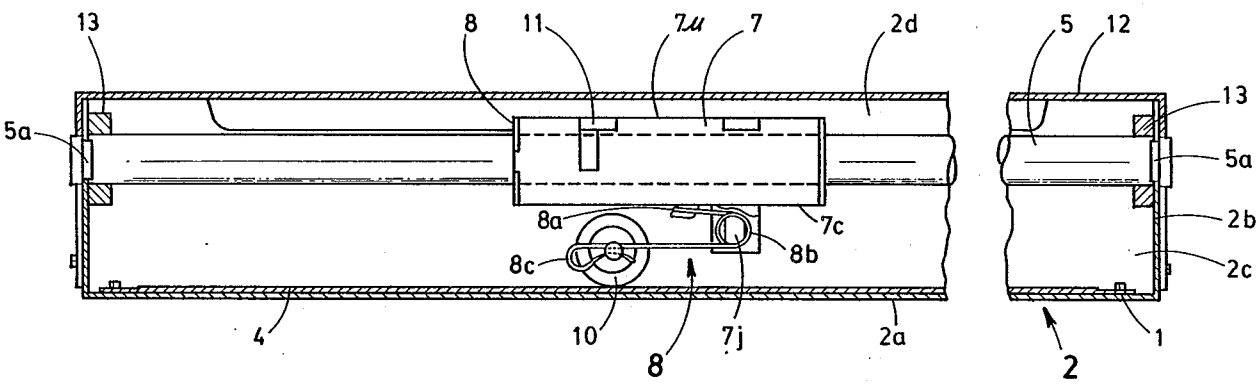
FIG. 1 is a side, cross-sectional view of the present invention.
Figure 3:
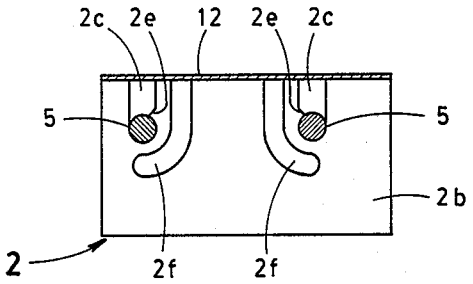
FIG. 3 is a side view of the present invention.

FIG. 3 is an end view of the present invention. As shown in FIG. 3, there are two pairs of adjacent open-ended slots 2*c* and 2*e* extending downward from the top of each of the two vertical end-walls 2*b* of the case 2. Each of the slots 2*f* is adjacent to each of the slots 2*c* in order to allow the narrow wall section between each slot pair 2*c*,2*f* to slightly bend during installation of guide bars 5. As shown in FIGS. 1 and 3, each guide bar downward into the slot 2*c*. Protrusions 2*e* are present in order to secure the guide bars 5 in the slots 2*c*.

Figure 2:
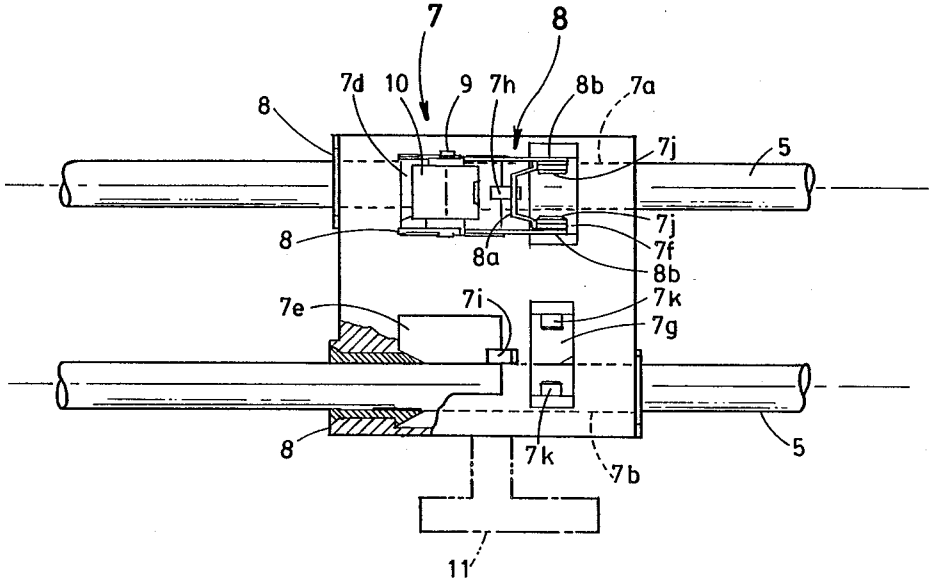
FIG. 2 is a bottom view of the slider according to the present invention.

FIG. 2 illustrates the relationship between a slider 7 and the two guide bars 5. The slider 7 is equipped with two guide holes 7*a* and 7*b* which accommodate the two guide bars 5. One end of guide hole 7*a* and both ends of guide hole 7*b* are fitted with a low friction bushing 8*a*, 8*b* and 8*c*, respectively. A first pair of identical rectangular cavities 7*d* and 7*e*, and a second pair of identical rectangular cavities 7*f* and 7*g* are cutout of the bottom 7*c* of the slider 7. Hooks 7*h* and 7*i* are respectively located between cavities 7*d*,7*f* and 7*e*,7*g*. In the preferred embodiment, each cavity 7*f* and 7*g* contains a pair of inwardly extending protrusions 7*j* and 7*k*. As shown in FIGS. 1 and 2, coiled sections 8*b* of a coiled spring 8 are fitted over the inwardly extending protrusions 7*j* and the spring 8 is secured in place by engaging the mid-section 8*a* with hook 7*h*. A coiled spring, although not shown for clarity, is also be attached to protrusions 7*k* and hook 7*i* in like fashion.

Figure 5:
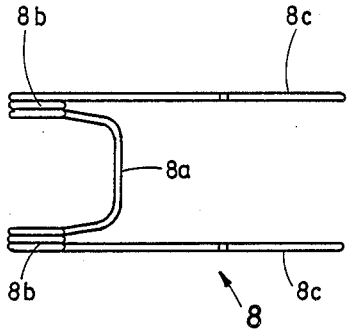
FIG. 5 is a top view of a spring in the slider according to the present invention.

The coiled spring serves as a suspension member between the slider or carriage 7 and the roller element 10. The coiled spring 8 will be further explained with reference to FIGS. 5 and 6. The coiled spring 8 consists of a mid-section 8*a* which is to be secured to the hook 7*h*, two coils 8*b* which fit over the inwardly extending protrusions 7*j*, and two legs 8*c* that are each bent into a hair pin shape 8*d* for receiving the roller shaft 9.

Returning to FIGS. 1 and 2, it can be seen that each end of the roller shaft 9 has an annular groove which fits the hairpin-like section 8*d* of the coiled spring 8 in order to allow free rotation of the roller shaft 9 and the conductive roller 10.

Figure 6:
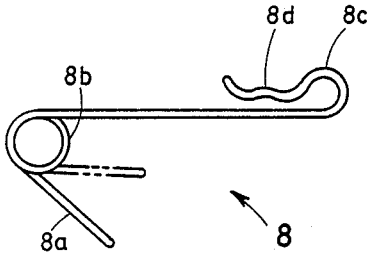
FIG. 6 is a side view of the spring in FIG. 5.

In FIG. 6, the bold lines represent the coiled spring 8 in its uncompressed state. When the coiled spring 8 is installed on slider 7, the spring mid-section 8*a*, as shown by the broken line, will be compressed between the slider 7 and the roller 10 inside of the case 2 (see FIG. 1). Thus, the coiled spring 8 operates to bias the conductive roller 10 towards the conductive and resistive elements 3 and 4.

As shown by FIG. 1, a preferred embodiment of a variable resistor according to the present invention includes an open rectangular case 2 that is covered with a lid 12. Slider arm 11 is mounted on the upper section 7*u* of the slider 7. An elongated slit 2*d* is present in a wall 2*c* of case 2 so that the slider arm 11 may extend therethrough and be moved by the operator. Cushion rings 13 are installed at both ends of each of the two guide bars 5 near the vertical end-walls 2*b* of the case 2. The cushion rings 13 are present to dampen the shock from the slider 7 hitting the vertical end-wall 2*b* of the case.

The operation of the variable resistor of FIGS. 1 to 6 will now be explained. When the slider arm 11 is moved along the slit 2*d*, the conductive roller 10 will roll while being biased against the resistive element 3 and conductive element 4. A desired resistance can be obtained because, as the slider arm 11 is moved, the conductive roller 10 will change position so as to change the effective resistor length between terminals 3*a* and 4*a* (or between 3*b* and 4*a*).

If the above composition is employed, the construction will be simple and the components few as the only component supporting the conductive roller 10 and shaft 9 is the coiled spring 8.

The assembly of the conductive roller 10 and the shaft onto the slider 7 is as follows: the shaft 9 is first fit in the bent hairpin-like section 8*d* of the coiled spring 8; then the two coiled sections 8*b* of the spring are fitted onto the two protrusions 7*j* (or 7*k*); and finally the spring mid-section 8*a* is secured to the hook 7*h* (or 7*i*). The steps for installing the guide bars 5 include: inserting the annular groove 5*a* of the guide bar 5 into slot 2*c* and pressing guide bar 5 down in order to bend the wall between slot 2*c* and slot 2*f* so as to force and firmly secure the annular groove 5*a* below retaining protrusion 2*e*.

The variable resistor according to the present invention is less prone to noise generation when resistance is varied because the conductive roller 10 is biased against the resistive element 3 and conductive element 4 by coiled spring 8 and therefore is less apt to lift up from the resistive element 3 and the conductive element 4 as it rolls in contact over the two elements 3 and 4. Note that the motion is extremely smooth because the conductive roller 10 rolls as it moves. Hence, friction between the roller 10 and the resistive and conductive elements 3 and 4 is only rolling friction. Moreover, even after the roller element 10, the resistive element 3, and the conductive element 4 have been worn from excessive use, performance is less apt to deteriorate because the conductive roller 10 continues to roll over the elements 3 and 4 under pressure from coiled spring 8. Finally, the variable resistor according to the present invention can be installed and used at any angle of attitude.

While the above disclosed features of the present invention teach an improved variable resistor, it can be readily appreciated that it would be possible to deviate from the above embodiments of the present invention, for instance, in the above embodiment, conductive silicon rubber is used in the conductive roller 10, but it need not be limited to this material. For example, a normal synthetic rubber roller can be used with a conductive coating. The resistive element 3 and the conductive element 4 could be made of elastic material and the roller 10 of rigid material. Three terminals are provided but it could be only two (e.g. 3*a* and 4*a* or 3*b* and 4*a*) or could be four in order to provide many different connections. It is also possible that the either resistive terminals 3*a* and/or 3*b* could be used in conjunction with a terminal that is connected directly to the conductive roller 10 of the slider 7. Needless to say, the above actual example can be converted into a motor driven variable resistor. Also, in the above example, only one conductive roller 10 was used but is possible to use two. Accordingly, it will be understood that the invention is not to be limited by the specific embodiments but only by the spirit and scope of the appended claims.

What is claimed is:

1. An improved variable resistor comprising:

a conductive element;

a resistive element;

a contact means for conductively contacting the conductive element and the resistive element, the contact means having a rolling contact surface.

a guide means comprising a carriage for guiding said contact means over the conductive element and the resistive element at a fixed displacement relative thereto;

a support means for supporting the conductive element, the resistive element, and the guide means; and a suspension member attached to said contact means and said carriage, said suspension member supporting said contact means while simultaneously biasing said contact means away from said carriage and towards said conductive and resistive elements.

2. The improved variable resistor of claim 1, wherein the suspension member is a coiled spring.

3. The improved variable resistor of claim 1 wherein the conductive element and the resistive element lay parallel to each other.

4. The improved variable resistor of claim 1 wherein the support means is an insulator plate.

5. The improved variable resistor of claim 1 wherein the rolling contact surface of the contact means is a cylindrically shaped rolling contact surface.

6. The improved variable resistor of claim 1 wherein the rolling contact surface is smooth in configuration to provide continuous contact with the conductive element and the resistive element.

7. The improved variable resistor of claim 1 further including activating means for activating a movement of the contact means.

8. The improved variable resistor of claim 1 wherein the guide means is a pair of cylindrical guide bars.

9. An improved variable resistor of the kind that includes a conductive element, a resistive element, a rolling contact element that contacts the conductive and resistive elements, and a guide means form guiding the rolling contact element over the conductive and resistive elements, said guide means including a carriage at a fixed displacement relative to the conductive and resistive elements, the improvement comprising:

a suspension member attached to said carriage and said rolling contact element, said suspension member supporting said rolling contact element while simultaneously biasing said rolling contact element away from said carriage and towards said conductive and resistive elements.

10. The improved variable resistor of claim 9 wherein the suspension member is a coiled spring.

11. An improved variable resistor comprising:

a substantially planar mounting plate having an upper surface;

an elongated resistive element formed on the upper surface of the mounting plate;

an elongated conductive element formed on the upper surface of the mounting plate and adjacent to the elongated resistive element;

a rolling contact element which electrically connects the resistive element and the conductive element to one another;

a guide means supported above the mounting plate for guiding the rolling contact element along the length of the resistive and conductive elements, said guide means comprising a carriage;

a suspension member attached to said rolling contact element and said carriage, said suspension member supporting said rolling contact element while simultaneously biasing said rolling contact element away from said carriage and towards said conductive and resistive elements.

12. The improved variable resistor of claim 11 wherein the guide means is further comprised of at least one cylindrical guide bar, said carriage being slidably supported by said at least one cylindrical guide bar.

13. The improved variable resistor of claim 11 wherein the suspension member is a coiled spring.

14. The improved variable resistor of claim 11 wherein the conductive element and the resistive element lay parallel to each other.

15. The improved variable resistor of claim 11 wherein the planar mounting plate is an insulator plate.

16. The improved variable resistor of claim 11 wherein the rolling contact means includes a cylindrically shaped rolling contact surface.

17. The improved variable resistor of claim 16 wherein the rolling contact surface is smooth in configuration to provide continuous contact with the conductive element and the resistive element.

18. The improved variable resistor of claim 11 further including activating means for activating a movement of the contact means.

* * * * *